United States Patent [19]

Lindsey

[11] 4,184,219

[45] Jan. 22, 1980

[54] METHOD OF STRETCHING AN UPPER ABOUT THE VAMP OF A LAST

[75] Inventor: William C. Lindsey, Milford, Mass.

[73] Assignee: International Shoe Machine Corporation, Nashua, N.H.

[21] Appl. No.: 932,581

[22] Filed: Aug. 10, 1978

[51] Int. Cl.[2] ..... A43D 21/00

[52] U.S. Cl. ..... 12/145

[58] Field of Search ..... 12/14.5

[56] References Cited

U.S. PATENT DOCUMENTS

| | | | |
|---|---|---|---|
| 3,008,157 | 11/1961 | Weinschenk | 12/14.5 |
| 3,535,723 | 10/1970 | Sommer | 12/14.5 |
| 3,902,211 | 9/1975 | Lindsey | 12/14.5 |

*Primary Examiner*—Patrick D. Lawson

*Attorney, Agent, or Firm*—Albert Gordon

[57] ABSTRACT

A method for stretching an upper mounted on a last about the vamp of the last while the last is supported bottom-down. The last has a throat between the tops of its toe and cone portions that is bridged by the upper with the upper being spaced from the throat above the throat. The upper margin is gripped toewardly of the throat by toe pincers and heelwardly of the throat by ball pincers. The ball pincers are then moved towards the toe pincers to cause the upper above the throat to buckle into the throat and bear against the throat after which the last is raised to effect the stretching of the upper about the vamp of the last.

3 Claims, 8 Drawing Figures

METHOD OF STRETCHING AN UPPER ABOUT THE VAMP OF A LAST

BACKGROUND OF THE INVENTION

U.S. Pat. No. 3,902,211 and British patent specification No. 1,341,967 are illustrative of machines, that are operable on a shoe assembly formed of a last having an insole located on its bottom and an upper mounted thereon, for stretching the upper about the vamp of the last prior to wiping the toe portion of the upper margin against the corresponding portion of the insole. In the operation of these machines, the shoe assembly is supported bottom-down on a support; front pincers are caused to grip the upper margin proximate to its toe end extremity; back pincers are caused to grip the upper margin on each side of the upper margin heelwardly of the upper margin portion or portions gripped by the front pincers; and relative upward movement of the support with respect to the pincers is effected to effect said stretching.

The last, as is conventional, has a reentrant portion or throat between the top of its toe and the front of its cone. When certain types of uppers having one-piece portions made of relatively stiff material are mounted over the throat of the last, the upper material bridges over and is spaced from the throat so that the stretching operation does not result in the upper being snugly fitted against the throat, thus resulting in a poorly fitted shoe.

SUMMARY OF THE INVENTION

This invention has the object of overcoming the problem described in the preceding paragraph. This is accomplished by moving the back pincers towards the front pincers while the front and back pincers are gripping the upper margin and prior to effecting the relative upward movement of the support with respect to the pincers.

DESCRIPTION OF THE PREFERRED EMBODIMENT

Figure 1:
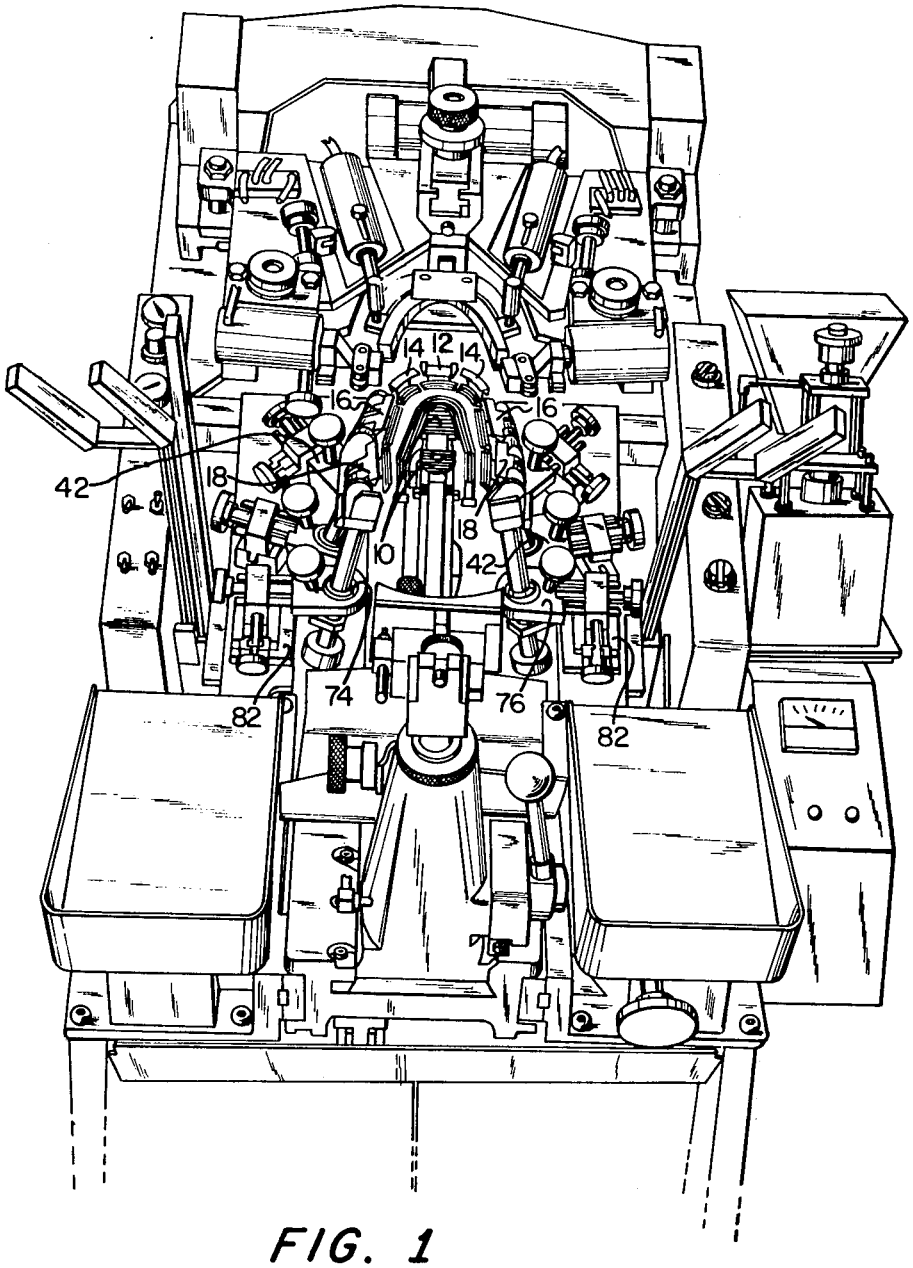
FIG. 1 is a front view of a machine which practices the invention.

The operator is intended to stand in front of the machine as seen in FIG. 1. Machine parts closest to the operator are considered to be at the front of the machine and machine parts furthermost from the operator are considered to be at the back of the machine. Parts moving towards the operator are considered to have "forward" movement and parts moving away from the operator are considered to have "rearward" movement.

The machine is inclined for ease of presentation of shoe assemblies thereto. However, for ease of explanation, the plane of the top of the insole rest 10 (see FIG. 7) referred to below will be considered to be a horizontal plane.

Referring to FIG. 1, the machine includes the insole rest 10. A toe pincers assembly 12 is located rearwardly of the insole rest 10 and side pincers assemblies 14 and 16 are located on each side of the insole rest 10 forwardly of and on each side of the toe pincers assembly 12. The side pincers assemblies 14 which are the rearmost side pincers assemblies closest to the toe pincers assembly 12 are corner pincers assemblies. The side pincers assemblies 16 which are forward of the corner pincers assemblies 14 are forepart pincers assemblies. Ball pincers assemblies 18 are located on each side of the insole rest 10 and forwardly of the forepart pincers assemblies 16.

Figure 2:
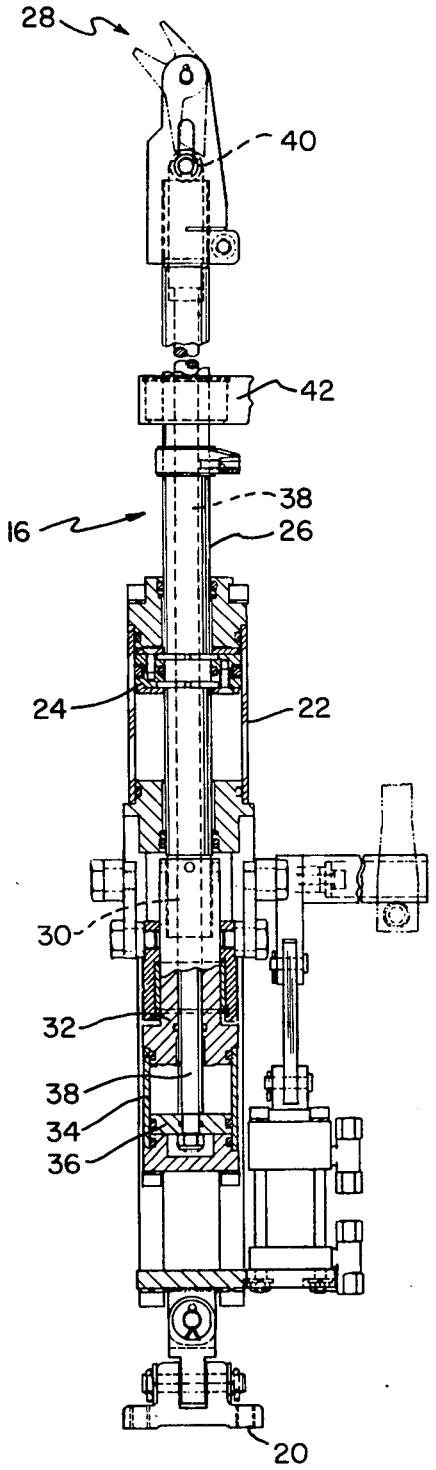
FIG. 2 is a partially sectional view of a forepart pincers assembly in the machine.

FIG. 2 shows a forepart pincers assembly 16. The construction of the toe pincers assemblies 12 and the corner pincers assemblies 14 are basically the same as the below-described construction of the forepart pincers assemblies 16.

Each of the pincers assemblies 12, 14, and 16 is mounted to a base plate 20. An air actuated motor 22, on each of these pincers assemblies, incorporates a piston 24 mounted for heightwise movement. Each piston 24 is affixed to a sleeve 26 also mounted for heightwise movement, and each sleeve 26 is mounted at its top to a pincers 28 formed of a pair of relatively movable jaws whereby heightwise movement of a piston 24 causes corresponding heightwise movement of its associated pincers 28. The bottom of each sleeve 26 is secured by a threaded connection 30 to a post 32 and the bottom of each post 32 forms the top portion of an air actuated motor 34 whereby each motor 34 is mounted to its associated pincers assembly for heightwise movement in unison with its associated sleeve 26. Each motor 34 incorporates a piston 36 and each piston 36 is affixed to a shaft 38 that is slidably mounted for heightwise movement within its associated post 32 and sleeve 26. A cam roll 40 on the top of each shaft 38 is adapted to close the normally open jaws of its associated pincers 28 in response to upward movement of its associated shaft 38 in the manner disclosed in U.S. Pat. No. 3,902,211. Each sleeve 26 is slidably guided for heightwise movement in a guide 42 (FIGS. 1 and 2) that is fixedly mounted in the machine.

Figure 3:
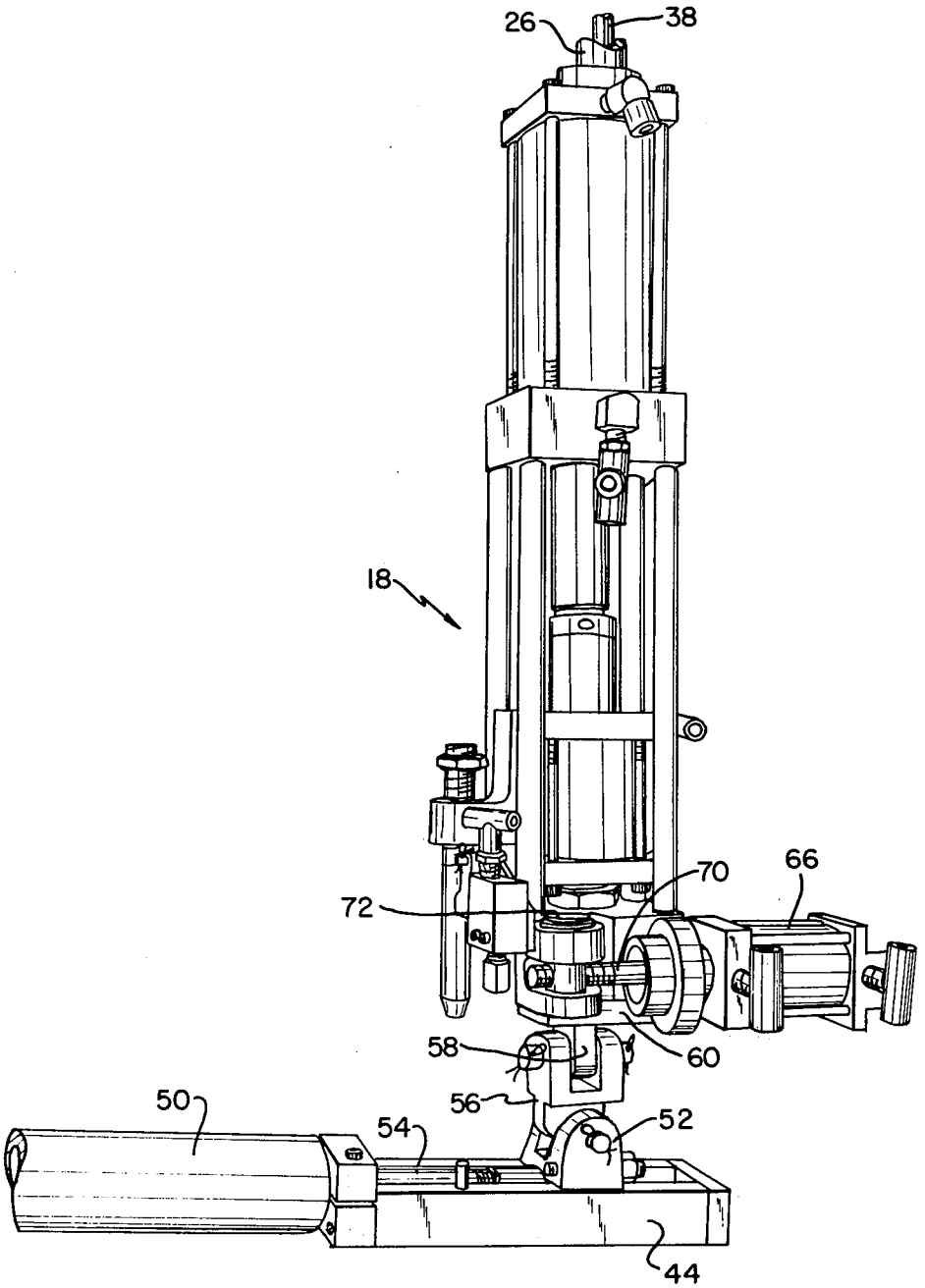
FIGS. 3 and 4 are isometric views of the lower part of a ball pincers assembly and its mounting in the machine.
Figure 4:
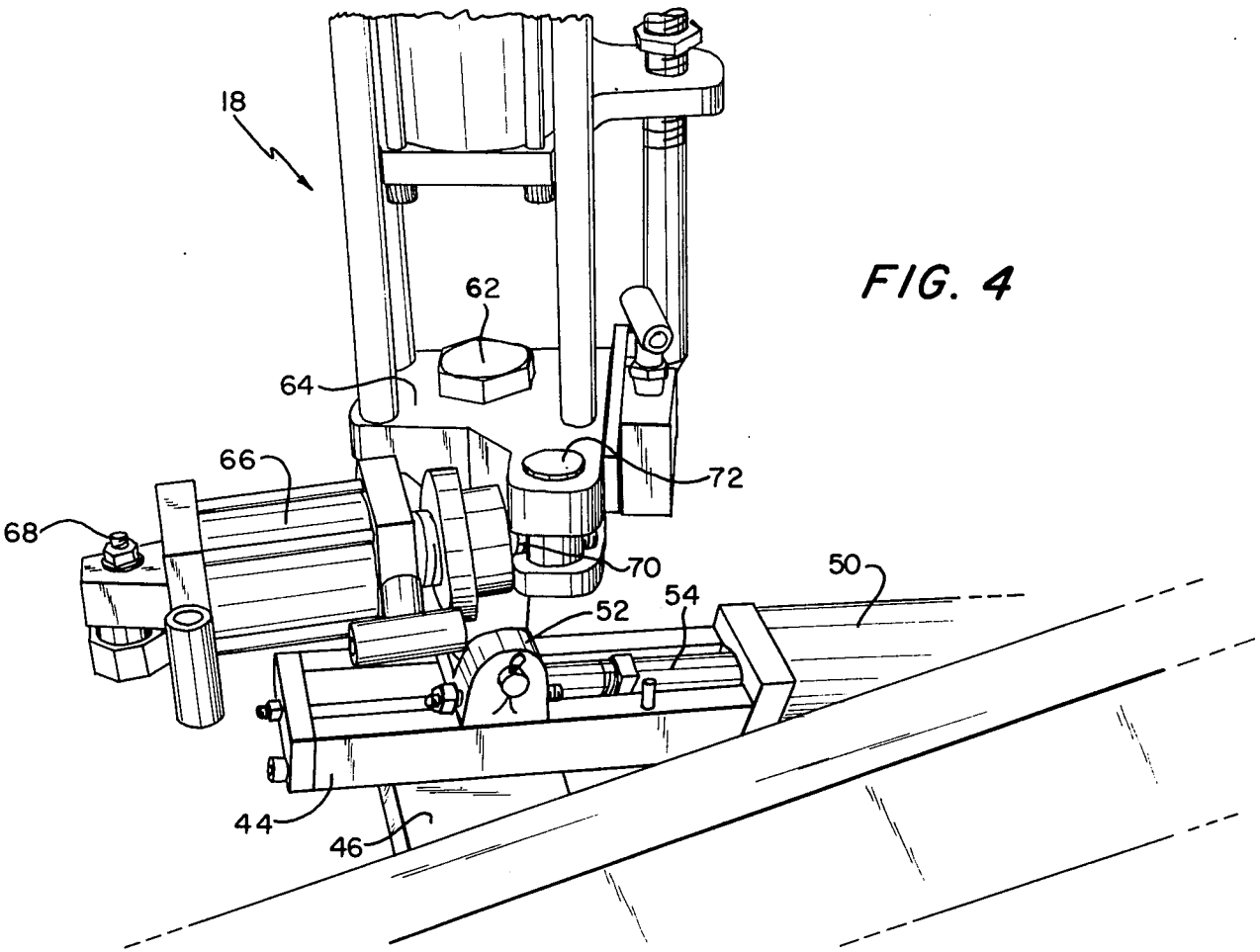

FIGS. 3 and 4 show one of the ball pincers assemblies 18 and its mounting in the machine. Each of the ball pincers assembly mountings includes slideway 44 that is secured to a fixed strap 46 of the machine frame. An air operated motor 50 is mounted to each slideway 44 and a slide 52 is slidably mounted to each slideway 44 for forward-rearward movement. The piston rod 54 of each motor 50 is secured to a slide 52 to enable the motors 50 to effect forward-rearward movements of the slides 52. Each slide 52 is connected by a universal joint 56 to a flange 58 and each flange 58 is secured to a bracket 60. A pivot pin 62, secured to each bracket 60, pivotally mounts the base 64 of a ball pincers assembly 18 for swinging movement about the heightwise extending axis of the pin 62. An air operated motor 66 is pivoted to each bracket 60 on a pivot pin 68 and the piston rod 70 of each motor 66 is pivotally connected to its associated pincers base 64 by a pivot pin 72 to enable the motors 66 to effect swinging movement of their associated ball pincers assemblies 18 about the axes of the pins 62.

Each ball pincers assembly 18 incorporates motors 22 and 34, a sleeve 26, a shaft 38 and a pincers 28 constructed similarly to the corresponding structure, shown in FIG. 2, to mount the pincers 28 of the ball pincers assemblies 18 for heightwise movement and for opening and closing movements.

Figure 5:
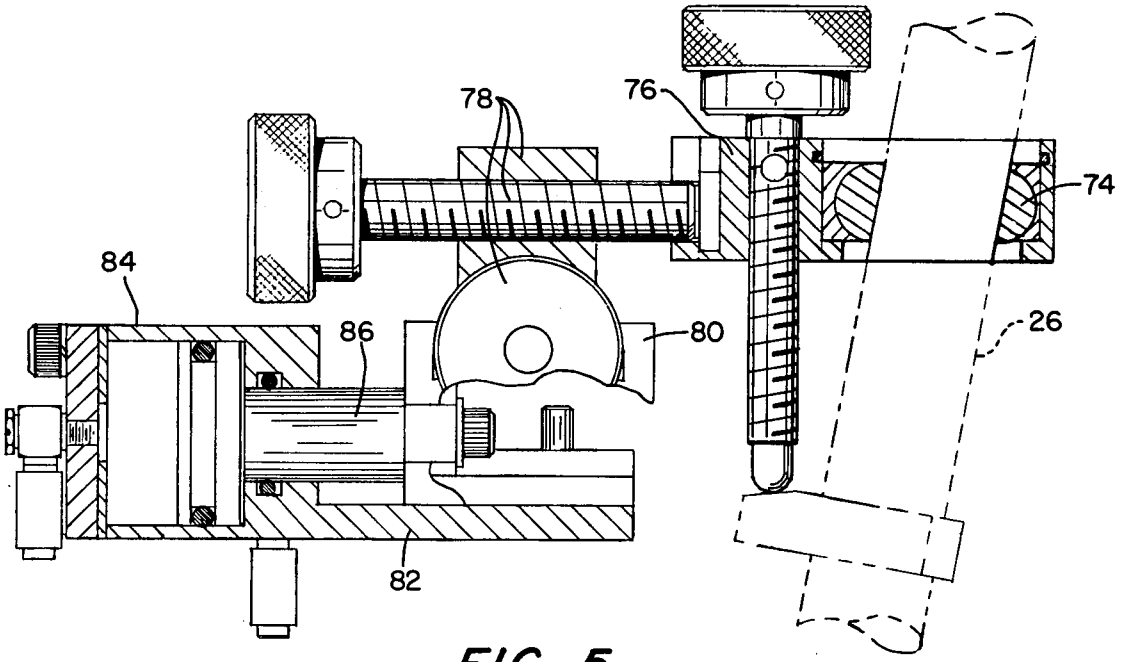
FIG. 5 is a section of a guide arrangement for the upper part of the ball pincers assembly.

Referring to FIG. 5, the sleeve 26 of each ball pincers assembly 18 is guided for heightwise movement in a bearing 74 that is mounted for universal movement to a bracket 76. Each bracket 76 is connected by connecting elements 78 to a slide 80. Each slide 80 is slidably mounted for inward-outward movement towards and away from the longitudinal center of line of the machine on a base 82 that is fixedly mounted to the machine. Each base 82 incorporates an air operated motor 84 whose piston rod 86 is connected to its associated slide 80 whereby the motors 84 may effect inward-outward swinging movement of their associated ball pincers assemblies 18 about their associated universal joint 56.

Figure 6:
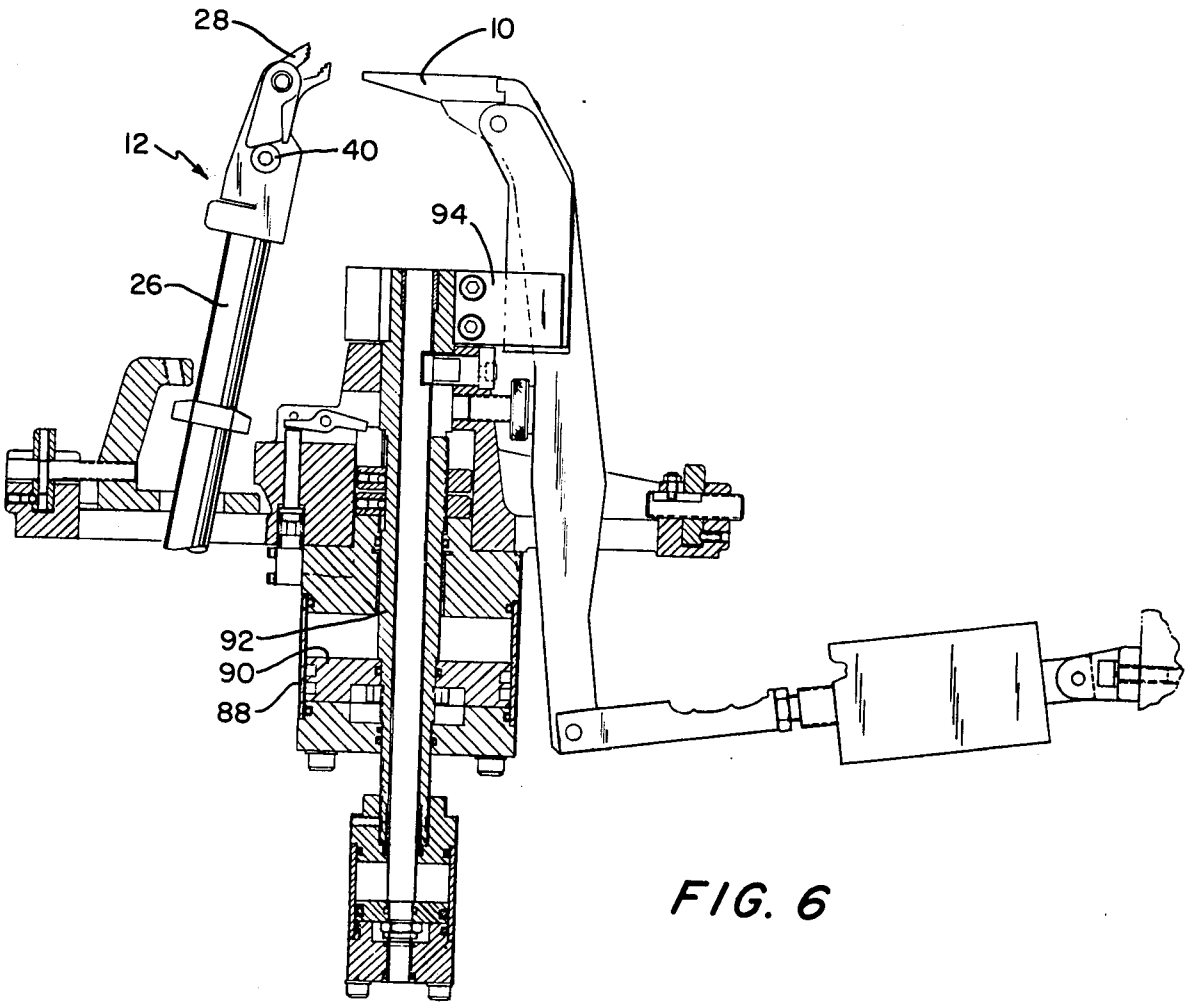
FIG. 6 is a section of a mechanism for moving a support in the machine heightwise.

Referring to FIG. 6, an air operated motor 88, fixed to a stationary part of the machine, has a heightwise movable piston 90. The piston 90 is affixed to a sleeve 92 that, in turns, is affixed at its upper end to a collar 94. The insole rest 10 is affixed to the collar 94 whereby heightwise movement of the piston 90 causes corresponding heightwise movement of the insole rest 10.

In the idle condition of the machine: the pistons 24 of the motors 22 of all of the pincers assemblies 12, 14, 16, and 18 are in their upper positions, shown in FIG. 2, so that the pincers 28 of all of the pincers assemblies are in raised positions, the ball pincers assemblies 18 being so constructed that their pincers 28 are at higher elevations than the pincers 28 of the pincers assemblies 12, 14 and 16; the pistons 36 of all of the pincers assemblies 12, 14, 16, and 18 are in their lowered positions, shown in FIG. 2, so that the pincers 28 of all of the pincers assemblies 12, 14, 16, and 18 are open; the piston rods 54 are retracted into the motors 50 so that the ball pincers assemblies are so swung about the fulcrum provided by the bearings 74 that the pincers 28 of the ball pincers assemblies 18 are in forward positions; the piston rods 70 are projected out of the motors 66 so that the longitudinal dimensions 96 (see FIG. 7A) of the ball pincers assemblies 18 extend in generally forward-rearward directions parallel to the longitudinal center line of the machine; the piston rods 86 are retracted into the motors 84 so that the ball pincers assemblies 18 are swung about the universal joints 56 into outer positions; and the piston 90 is in its lowered position in the motor 88, as shown in FIG. 6, so that the insole rest 10 is in a lower position.

Figure 7:
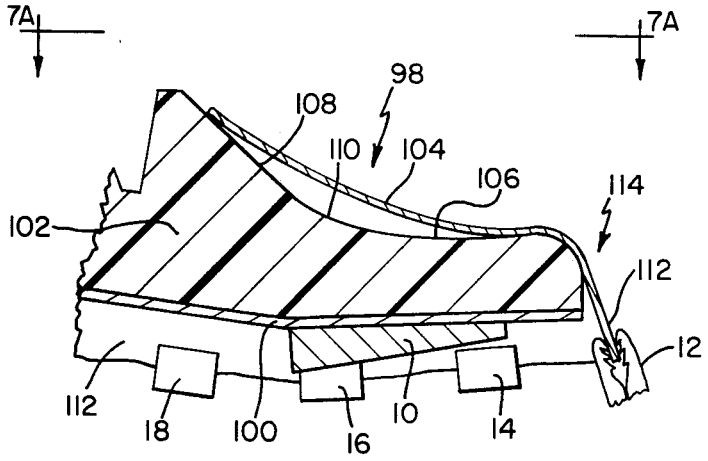
FIG. 7 is a representation in sectional elevation of a shoe assembly in the machine at the beginning of a machine cycle.
Figure 7A:
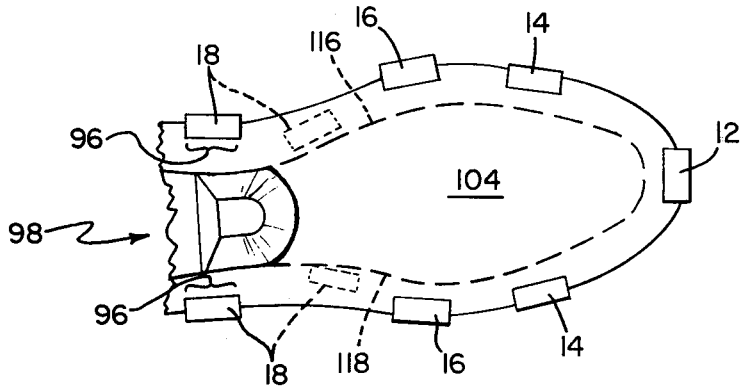
FIG. 7A is plan view taken along the line 7A–7A of FIG. 7.

Referring to FIGS. 7 and 7A, a shoe assembly 98 is presented bottom-down to the machine. The shoe assembly 98 comprises a shoe insole 100 located on the bottom of a last 102 and a shoe upper 104 draped over the last. The top 106 of the toe of the last 102 and the front 108 of the cone of the last are joined by a reentrant portion or throat 110. The portion of the upper 104 that is draped over the last portions 106 and 108 is made of a one-piece relatively stiff material that bridges the throat 110 and is spaced therefrom as indicated in FIG. 7. The operator inserts the upper margin 112 between the pincers jaws of all of the pincers assemblies 12, 14 16, and 18. This is followed by an actuation of the motor 36 of the toe pincers assembly 12 to raise its shaft 38 and thus close the pincers 28 of the toe pincers assembly on the toe end extremity of the upper margin 112 and thereby cause this pincers to grip the toe end extremity of the upper margin 112. This is followed by a similar actuation of the motors 36 of the ball pincers assemblies 18 to cause the ball pincers jaws to grip the ball portions of the upper margin 112 in regions that are rearward and heelward of the last throat 110.

Now there is a concurrent actuation of the motors 22 of the ball pincers assemblies 18 and the motors 50. The actuation of these motors 22 causes the pistons 24 to be lowered to thereby lower the pincers 28 of the ball pincers assemblies 18 and the actuation of the motors 50 causes the piston rods 54 to be projected therefrom to cause the pincers 28 of the ball pincers assemblies 18 to be swung rearwardly towards the toe end 114 of the shoe assembly 98. These movements move the gripped ball portions of the upper margin 112 toewardly and downwardly while the toe end extremity of the upper margin 112 is restrained against movement by the pincers of the toe pincers assembly 12 to thereby cause the portion of the upper 104 that is bridging the throat 110 to buckle into and bear against the throat. There are occasions, due to the heel height of the shoe assembly 98 and/or the width of the upper margin 112 when the pincers of the ball pincers assemblies 18 are not initially located higher than the pincers of the pincers assemblies 12, 14, and 16, in which event the pincers 28 of the ball pincers 18 are moved toewardly without being lowered which still enables the portion of the upper 104 that is bridging the throat 110 to buckle into and bear against the throat 110.

Now the motors 34 of the pincers assemblies 14 and 16 are so actuated as to cause the pincers of these pincers assemblies to grip the portions of the upper marin 112 that are located between the gripped toe end extremity and ball portions of the upper margin. This is followed by actuation of the motor 88 to raise the piston 90, together with the insole rest 10, while the upper margin is gripped by the pincers 28 of all of the pincers assemblies 12, 14, 16, and 18. to thereby cause the upper 104 to be stretched about the vamp of the last 102.

Now there are concurrent actuations of the motors 84 to project their piston rods 86 inwardly and of the motors 66 to retract their piston rods 70. In the idle condition of the machine, the pincers 28 of the ball pincers assemblies 18 were spaced outwardly of the sides of the shoe assembly 98 so as to not interfere with the placement of the shoe assembly on the insole rest 10. This actuation of the motors 84 causes the pincers of the ball pincers assemblies to move inwardly towards the longitudinal center line of the shoe assembly 98 along its toe-heel axis and this actuation of the motors 66 causes these pincers to swing about the axes of the pins 62 in such directions that the forward, heelmost ends of the longitudinal dimensions 96 (FIG. 7A) move inwardly towards the longitudinal center line of the shoe assembly. These movements of these pincers cause them to be located close to the reentrant portions of the sides of the last 102 heelwardly of the ball breaks 116 and 118 (FIG. 7A) with the longitudinal dimensions 96 of these pincers extending substantially parallel to these portions of the sides of the last, as indicated in phantom in FIG. 7A. As a result, the upper margin portions gripped by the pincers 28 of the ball pincers assemblies 18 are located close to and substantially parallel to these reentrant portions of the sides of the last 102 to thereby inhibit fade away or slippage of these portions of the upper margin 112 during the below-described wiping of the toe portion of the upper margin against the insole 100.

The remainder of the machine cycle is similar to that disclosed in U.S. patent application Ser. No. 4,155,135 filed May 15, 1978, in U.S. Pat. No. 3,902,211, and in British patent specification No. 1,341,967. As disclosed in these references, the shoe assembly 98 is clamped in position on the insole rest 10, adhesive is extruded onto the margin of the toe portion of the insole 100, and the toe portion of the upper margin 112 is wiped by wipers against the corresponding portion of the periphery of the insole 100 with the various pincers 28 releasing the stretched upper margin at such times as to enable the wipers to effect the wiping operation.

There follows a description of the machine and its mode of operation as they pertain to this invention.

The machine is operable on the shoe assembly 98 formed of the last 102 having the insole 100 located on its bottom and the upper 104 mounted thereon to stretch the upper about the vamp of the last prior to wiping the toe portion of the upper margin 112 against the corresponding portion of the insole 100. The top of the last has the reentrant throat 110 located between its toe portion 106 and its cone portion 108. The upper has a portion that bridges the throat and is spaced therefrom. The shoe assembly 98 is supported bottom-down on the insole rest 10 which acts as a support. The pincers 28 of the toe pincers assembly 12, which act as front pincers, is caused to grip the upper margin 112 toewardly of the throat 110. The pincers 28 of the ball pincers assemblies 18, which act as back pincers, are caused to grip the upper margin 112 on each side of the shoe assembly 98 heelwardly of the throat 110. The motor 88 effects upward movement of the support 10 to thereby effect relative upward movement of the support 10 with respect to the pincers to effect said stretching of the upper. The back pincers are moved towards the front pincers while all of said pincers are gripping the upper margin 112 and prior to effecting said relative upward movement to cause said upper portion to buckle into and bear against the throat.

The pincers 28 of the side pincers assemblies 14 and 16, which act as intermediate pincers, are caused to grip the upper margin 112 on each side of the shoe assembly between the upper margin portions that are gripped by the front pincers and the back pincers subsequent to the movement of the back pincers towards the front pincers and prior to effecting said relative upward movement.

The back pincers are caused to move downwardly concomitantly with the movement of the back pincers towards the front pincers.

We claim:

1. A method, operable on a shoe assembly formed of a last having an insole located on its bottom and an upper mounted thereon, for stretching the upper about the vamp of the last prior to wiping the toe portion of the upper margin against the corresponding portion of the insole, the top of said last having a reentrant throat located between its toe and cone portions and the upper having a portion bridging the throat and being spaced therefrom, comprising: supporting the shoe assembly bottom-down on a support; causing front pincers to grip the upper margin toewardly of the throat; causing back pincers to grip the upper margin on each side of the shoe assembly heelwardly of the throat; and effecting relative upward movement of the support with respect to the pincers to effect said stretching, characterized in comprising: moving the back pincers towards the front pincers while all of said pincers are gripping the upper margin and prior to effecting said relative upward movement to cause the said upper portion to buckle into and bear against the throat.

2. The method of claim 1 further characterized in comprising: causing intermediate pincers to grip the upper margin on each side of the shoe assembly between the upper margin portions that are gripped by the front pincers and the back pincers subsequent to the movement of the back pincers towards the front pincers and prior to the effecting of said relative upward movement.

3. The method of claim 1 or claim 2 characterized in comprising: moving the back pincers downwardly concomitantly with said movement of the back pincers towards the front pincers.

* * * * *